US010336487B2

(12) United States Patent
Franzaroli

(10) Patent No.: US 10,336,487 B2
(45) Date of Patent: Jul. 2, 2019

(54) PROCESS FOR THE MANAGEMENT OF A FLOW OF MATERIAL ALONG A RESPECTIVE PLANT

(71) Applicant: PULSAR S.R.L., Castel Maggiore (IT)

(72) Inventor: Massimo Franzaroli, Castel Maggiore (IT)

(73) Assignee: PULSAR S.R.L., Castel Maggiore (IT)

( * ) Notice: Subject to any disclaimer, the term of this patent is extended or adjusted under 35 U.S.C. 154(b) by 633 days.

(21) Appl. No.: 14/780,908

(22) PCT Filed: Feb. 7, 2014

(86) PCT No.: PCT/IB2014/058852

§ 371 (c)(1),
(2) Date: Sep. 28, 2015

(87) PCT Pub. No.: WO2014/155211

PCT Pub. Date: Oct. 2, 2014

(65) Prior Publication Data

US 2016/0052657 A1 Feb. 25, 2016

(30) Foreign Application Priority Data

Mar. 29, 2013 (IT) ..... BO2013A0141

(51) Int. Cl.
*B65B 25/14* (2006.01)
*B65B 35/30* (2006.01)
(Continued)

(52) U.S. Cl.
CPC ..... *B65B 25/146* (2013.01); *B65B 35/30* (2013.01); *B65B 57/12* (2013.01); *B65B 57/16* (2013.01);
(Continued)

(58) Field of Classification Search
CPC ..... B65B 25/146; B65B 35/30; B65B 35/44; B65B 35/54; B65B 57/12; B65B 57/16;
(Continued)

(56) References Cited

U.S. PATENT DOCUMENTS 3,913,731 A * 10/1975 Purdom et al. ..... B65B 25/146 198/394
4,179,865 A * 12/1979 Pellaton ..... B65B 35/44 53/252

(Continued)

FOREIGN PATENT DOCUMENTS

EP 1127791 A1 8/2001
WO 2008/117150 A2 10/2008

OTHER PUBLICATIONS

International Search Report, dated Jul. 1, 2014, from corresponding PCT Application, PCT/IB2014/058852, 3 pages.

*Primary Examiner* — Stephen F. Gerrity
(74) *Attorney, Agent, or Firm* — Young & Thompson

(57) ABSTRACT

A process for the management of a flow of products along a plant for making and packing respective articles, in particular in the form of rolls, such as rolls of toilet paper or paper towels, an apparatus for making and packing the articles, in particular including one or more lines for making and packing the articles, a rewinding machine for making the semi-finished product and elements for accumulating or storing the semi-finished products, from which the making and packing apparatus, that is, the respective making and packing line, receives the semi-finished product and which, in turn, receives the semi-finished product from the rewinding machine for making a semi-finished product. According to the process, the respective operating speed of the respective line of the making and packing apparatus downstream is adjusted in such a way that the semi-finished product in the accumulation elements is kept around a predetermined filling level.

21 Claims, 3 Drawing Sheets

(51) Int. Cl.
*B65B 57/12* (2006.01)
*B65B 57/16* (2006.01)
*B65B 63/00* (2006.01)
*B65B 65/00* (2006.01)

(52) U.S. Cl.
CPC ..... *B65B 63/00* (2013.01); *B65B 65/003* (2013.01); *B65B 65/006* (2013.01); *B65B 2210/02* (2013.01)

(58) Field of Classification Search
CPC ..... B65B 63/00; B65B 63/04; B65B 65/003; B65B 65/006; B65B 2210/02
USPC ..... 53/430, 435, 118, 520, 77, 202
See application file for complete search history.

(56) References Cited

U.S. PATENT DOCUMENTS 4,328,931 A * 5/1982 Gordon-Clark et al. ..... B65H 23/198 226/118.1
4,394,896 A * 7/1983 McComas et al. ..... B65B 57/16 198/341.06
5,377,478 A * 1/1995 Kovacs et al. ..... B65B 25/146 53/389.5
5,433,063 A 7/1995 Kovacs et al.
5,706,627 A * 1/1998 Kirka et al. ..... B65B 65/003 493/18
5,934,047 A * 8/1999 Meyers ..... B65B 25/146 53/543
6,463,713 B1 * 10/2002 Ruemeli ..... B65B 25/146 198/437
6,738,684 B2 * 5/2004 Buchholz et al. ..... B65H 18/08 226/118.1
2001/0042359 A1 11/2001 Franzaroli
2002/0108353 A1 * 8/2002 Franzaroli ..... B65B 25/146 53/435
2005/0173227 A1 * 8/2005 Adamski et al. ..... B65B 25/146 198/579
2006/0175179 A1 * 8/2006 Christman et al. ... B65B 25/146 198/436
2009/0287330 A1 11/2009 Overley et al.
2010/0230238 A1 * 9/2010 Giuliani ..... B65B 35/44 198/418.3
2010/0230239 A1 * 9/2010 Bernardi ..... B65B 25/146 198/418.4

* cited by examiner

PROCESS FOR THE MANAGEMENT OF A FLOW OF MATERIAL ALONG A RESPECTIVE PLANT

TECHNICAL FIELD

This invention relates to a process for the management of a flow of material along a respective plant, in particular for making and packing respective articles.

More specifically, they are articles of absorbent paper, for cleaning and drying, for personal hygiene and/or for household use, such as rolls of toilet paper or of paper towels.

BACKGROUND ART

There are prior art plants for making and packing respective articles, in particular in the form of rolls of toilet paper or paper towels, which are obtained from corresponding semi-finished products, in particular in the form of respective logs or reels of paper-based material, and which comprise an apparatus for making and packing the articles, located downstream according to the direction of feed of the material being processed, in particular comprising one or more lines for making and packing the articles, an apparatus, or section, in particular a rewinding machine for making the semi-finished product, which is located upstream according to the direction of feed of the material being processed, as well as means for accumulating or storing the semi-finished products, from which the making and packing apparatus, that is, the respective making and packing line, receives the semi-finished product and which, in turn, receives the semi-finished product from the apparatus for making a semi-finished product.

In the prior art plants the apparatus for making and packing rolls comprises at least one cutting machine upstream, which performs the transversal cutting of the rolls from elongate logs or reels, having a length which is substantially a multiple of the length of the single roll to be cut, and one or more packing machines downstream, which pack the rolls in special wrappers, made from a film of plastic material or paper, which contain a chosen number of the items, if necessary arranged in respective rows and, if necessary, positioned on several layers.

The packing machines provide for a certain number of types of packs of rolls, each having predetermined dimensions and comprising a predetermined number of rolls, arranged according to a predetermined configuration. Moreover, each type of pack also differs according to the type of roll (geometrical dimensions) and type of paper used for forming the rolls.

In the prior art plants, one or more cutting machines are normally used wih which respective roll packing machines are associated.

Machines from different manufacturers are generally used in the prior art plants for making and packing the rolls. This occurs, for example, due to the fact that the machines have been purchased at different times, or due to the fact that the machines have been chosen as a function of specific advantageous features which the machines possess.

In the plants according to the prior art and in particular in the plants using machines coming from various manufacturers, there is, however, a problem of coordinating operation between the rewinding machines, cutting machines, packing machines, bagging machines and/or palletizing machines, as well as of these with the conveyor belts connecting between the machines, which results in a decidedly poor actual efficiency of the plants, which does not allow sufficient use of the potential, in terms of high operating speeds, of the above-mentioned prior art machines.

In these traditional plants, the operational settings, in particular of the operating speeds, of the various cutting and packing machines and of the conveying apparatus, for example every time that it is necessary to adjust the operation to a change in size of the packs of rolls to be made—that is to say, to the number and arrangement of the articles which must be packed in a single pack—are made independently for each single machine, by the operators, who use respective keypads for entering the data in the respective PLCs or local control units of the above-mentioned machines.

This way of proceeding, which results in an adjustment of the plant which could be referred to as "manual", is, however, quite unproductive. In effect, it is not easy for the operators to obtain a correct adjustment of the system, especially when it is necessary to control several size changes and the operators of the various machines have difficulty in communicating with each other. This also occurs due to the fact that the plants have very large dimensions and there is an objective difficulty in communicating, also as a result of the high noise level present in the plants, and in moving between the dense lines for conveying the articles.

Such a local adjustment of the operation of each machine of the plant usually leads to an incorrect operation of the plant.

To overcome these poor adjustments of the system in the prior art plants, use is made of normal automatic operation stopping controls, which are actuated by signals provided by maximum and minimum load optical sensors on the operational machines. In effect, it may occur that when the packing machines are fed with an excessive number of articles, a consequent automatic control signal is emitted for stopping the operation of the cutting machine upstream, whilst a corresponding signal for stopping the same packing machine is emitted when the machines are fed with an insufficient quantity of articles. Therefore, in the prior art plants, a fluctuating type of operation takes place, with work phases alternating with stoppages of the various machines of the plant. Thus, even in the presence of machines which are able to operate at high speeds, production outputs of the plant are achieved which are quite low, making futile the large financial investment for the purchase of these machines and, in any case, with a considerable waste of energy and excessive costs.

Moreover, this way of operating, which causes numerous stoppages of the cutting or forming machines upstream, as well as of the packing machines, also has adverse affects on the working life of the machines.

In effect, the components of the machines are subject to continuous accelerations and decelerations, to change them from the operating condition to the stopped condition, which produces stresses that, in the long term, causes faults to and wear of the main mechanical parts of the machines. The forming cutting machines comprise, for example, a large circular blade which, with a single movement in a plane transversal to the logs, or reels, simultaneously cuts several rolls, in particular a number of rolls equal to the number of logs which are fed to the cutting blade. Stoppages of the circular blade, due to emergency situations, can, over time, damage the movement mechanism of the blade, with significant repair costs and loss of production due to machine shut-down.

Moreover, in the traditional plants, the risk of overturning of the articles is high and the consequent stopping of the plant results in loss of production and, over time, the breakage and wear of the mechanical parts of the machines used. The number of overturnings which occur is influenced by the conveying speed of the articles and by the size of the rolls. Obviously, rolls which are short and have a large diameter have a higher risk of overturning.

Operating the cutting machine upstream at the maximum operating speed, as usually occurs, therefore increases the risk of overturning of the articles, at least with regard to certain types of products, such as the above-mentioned shorter rolls.

It should also be noted that, in the prior art plants, the rolls can be damaged, during transfer, by an excessively high conveying speed, especially a result of contact of the rolls with the conveyor guides.

Summing up, according to the traditional methods for regulating the flow of products in plants for toilet paper and paper towels there is an accelerated wear of the components of the plant, an excessive noise, an increase in the stresses and, therefore, risk of damage to the product, risk of overturning or poor positioning of the articles or products, and/or excessive energy consumption.

European patent EP1127791 describes a process for controlling the operation of a plant for the production of articles, in particular rolls of toilet paper, rolls of paper towels. As described in the above-mentioned patent document, a central processing unit takes data from the various machines of the plant and determines the respective maximum critical operating speed of the plant for the particular type of product.

According to the above-mentioned patent document, the operating speed of the plant is not greater than the critical speed.

Moreover, the above-mentioned patent document EP1127791 expressly states that, when a condition occurs in the plant that modifies the operation of the plant, the operation of the plant is reset as a function of the respective operating conditions of the other sections of the plant.

More specifically, the resetting procedure comprises, when the storage system which houses the logs has exceeded a number of pieces less than the predetermined level, in the event of an interruption to the feeding of articles to one of the machines or work units downstream, without reducing the operating speed of the cutting machine upstream, the operation of the plant downstream continues until the storage system is completely emptied.

DISCLOSURE OF THE INVENTION

This invention therefore proposes a new solution as an alternative to the solutions known up to now and, more specifically, proposes to overcome one or more of the above mentioned drawbacks and/or problems and/or to meet one or more of the needs felt in the trade or inferable from the above.

A process is therefore provided for managing a flow of material along a respective plant for making and packing respective articles, in particular articles made of absorbent paper, for cleaning and drying, for personal hygiene and/or for household use, especially in the form of rolls, such as rolls of toilet paper or paper towels; more specifically, the articles are obtained from corresponding semi-finished products, in particular in the form of elongate pieces or elements, preferably in the form of respective logs or reels, in particular made of paper-based material and in particular the articles are packed to form respective packs for containing one or more of the articles, housed in a respective container, or wrapper, made of suitable film, preferably of suitable plastic film; the plant comprises an apparatus for making and packing the articles located downstream according to the direction of feed of the material being processed having respective working sections, in particular comprising one or more lines for making and packing the articles; an apparatus, or section, in particular a rewinding machine, for making the semi-finished product, which is located upstream according to the direction of feed of the material being processed; and in particular means, or section, for accumulating or storing the semi-finished products, from which the making and packing apparatus, that is, the respective making and packing line, receives the semi-finished product and which in turn receives the semi-finished product from the apparatus for making a semi-finished product; characterised in that the operating speed of the sections of the plant, in particular of the apparatus for making and packing the articles is adjusted continuously as a function of an operating condition of one or more of the sections of the plant.

In this way, a uniform flow of material along the plant can be maintained almost continuously.

According to another advantageous aspect, a process is provided for managing a flow of material along a respective plant for making and packing respective articles, in particular articles made of absorbent paper, for cleaning and drying, for personal hygiene and/or for household use, especially in the form of rolls, such as rolls of toilet paper or paper towels; more specifically, the articles are obtained from corresponding semi-finished products, in particular in the form of elongate pieces or elements, preferably in the form of respective logs or reels, in particular made of paper-based material and in particular the articles are packed to form respective packs for containing one or more of the articles, housed in a respective container, or wrapper, made of suitable film, preferably of suitable plastic film; the plant comprises an apparatus for making and packing the articles located downstream according to the direction of feed of the material being processed having respective working sections, in particular comprising one or more lines for making and packing the articles; an apparatus, or section, in particular a rewinding machine, for making the semi-finished product, which is located upstream according to the direction of feed of the material being processed; and means, or section, for accumulating or storing the semi-finished products, from which the making and packing apparatus, that is, the respective making and packing line, receives the semi-finished product and which in turn receives the semi-finished product from the apparatus for making a semi-finished product; characterised in that the operating speed of the apparatus for making and packing the articles downstream, that is, of the respective making and packing line, is adjusted in such a way that the semi-finished product in the accumulation means, or section, is kept around a predetermined filling level.

In this way, in the case temporary interruptions or slowdowns in the receiving of products by the apparatus downstream, the possibility of storing the semi-finished product for a predetermined time is ensured, thus avoiding the need to stop the apparatus upstream.

BRIEF DESCRIPTION OF THE DRAWINGS

This and other innovative aspects, or advantageous features, are set out in the appended claims and its technical features and advantages are apparent from the detailed description which follows of preferred advantageous embodiments of it which must be considered purely as non-limiting examples; the description being made with reference to the accompanying drawings, in which:

DETAILED DESCRIPTION OF PREFERRED EMBODIMENTS OF THE INVENTION

Figure 3:
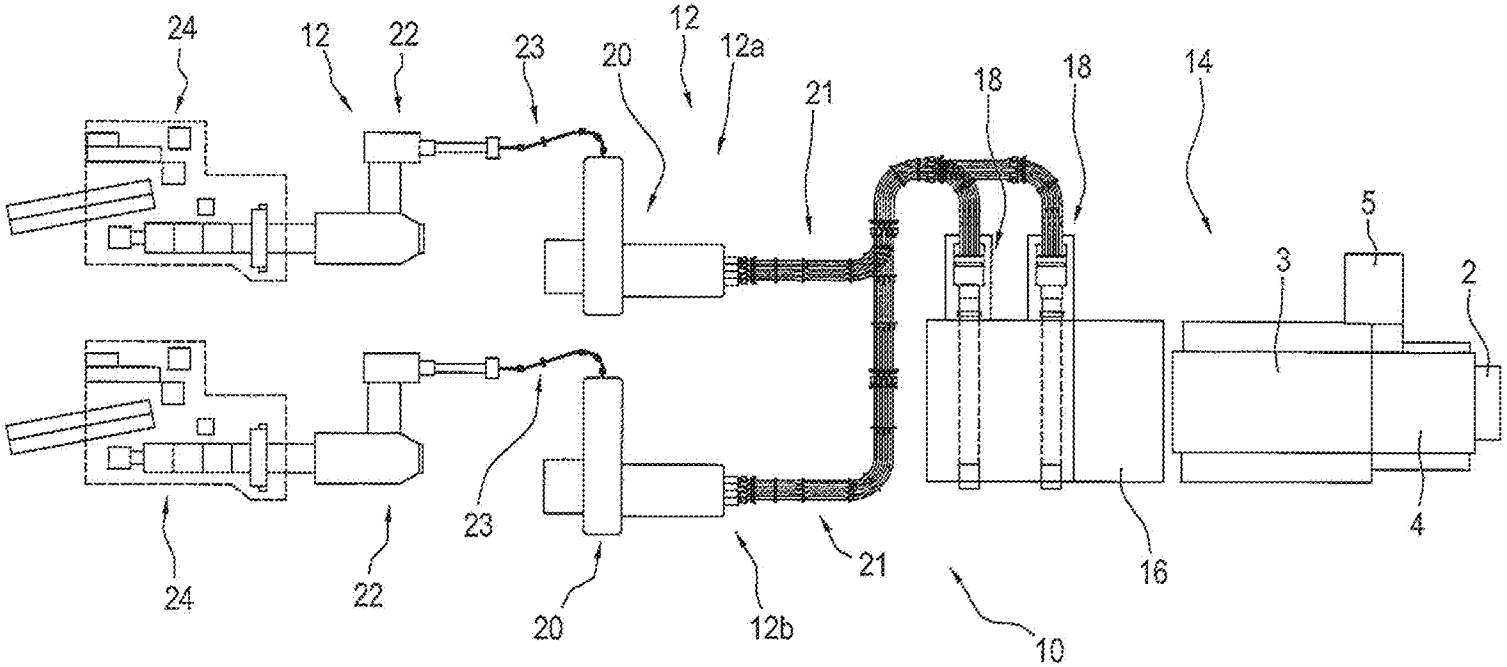
FIG. 3 is a schematic top plan view of a first preferred embodiment of the plant according to this invention, implementing this process for the management of the flow of material along the plant.
Figure 4:
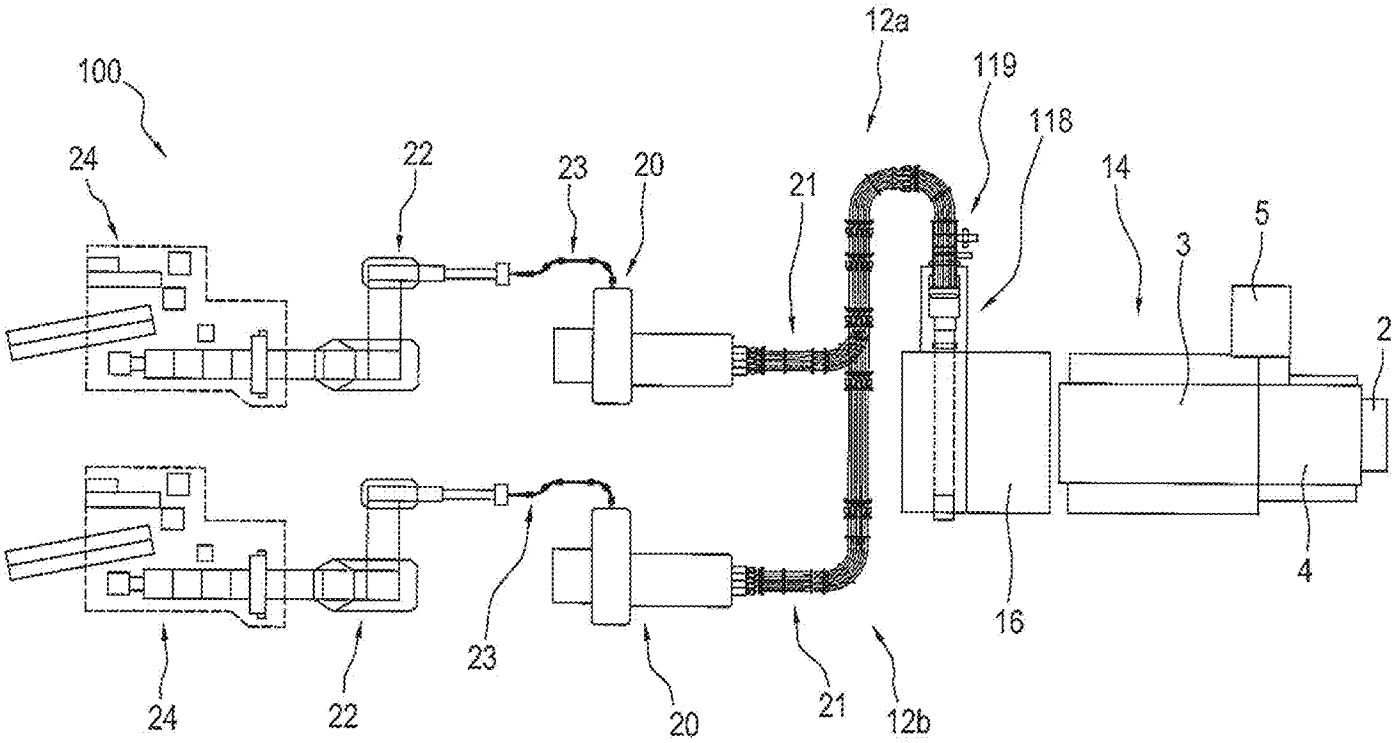
FIG. 4 is a schematic top plan view of a second preferred embodiment of the plant according to this invention, implementing this process for the management of the flow of material along the plant.

FIGS. 3 and 4 show a first and a second preferred embodiment 10, 100 of the plant for making and packing respective articles.

A preferred embodiment is also described below of a process for the management of the flow of material along the plant.

In this plant the articles processed are preferably in the form of articles of absorbent paper for cleaning and drying, for personal hygiene and/or for household use, and in particular are in the form of rolls of toilet paper or of paper towels.

Figure 1:
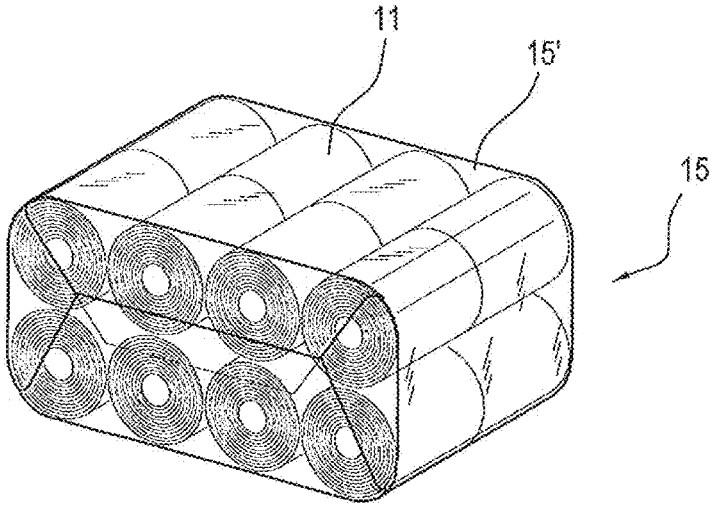
FIG. 1 is a schematic perspective view of a pack packed according to the plant.
Figure 2:
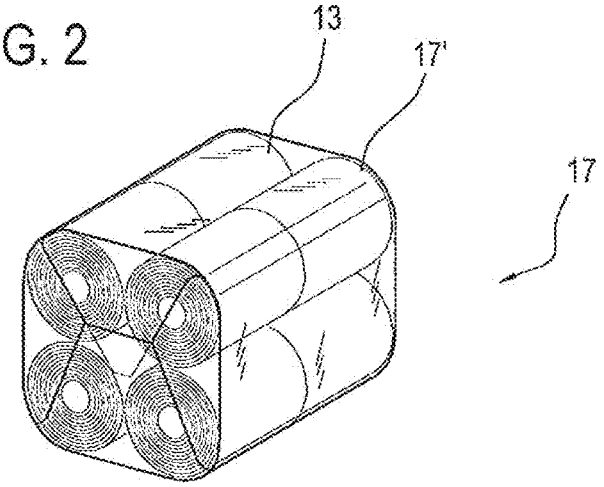
FIG. 2 is a schematic perspective view of a further preferred embodiment of a pack packed according to the plant.

More specifically, preferred embodiments of the articles processed are illustrated in FIGS. 1 and 2, denoted by the reference numerals 11 and 13, which are in the form of rolls of toilet paper and rolls of paper towels, respectively.

The articles are obtained from corresponding semi-finished products in particular in the form of elongate pieces or elements, preferably in the form of logs or reels, especially of paper material.

Moreover, the articles are packed to form respective packs, containing one or more of the articles, that is, housed in a respective container or wrapper of suitable film, preferably plastic film.

More specifically, the preferred embodiments of the packs 15 and 17 are illustrated in FIGS. 1 and 2.

More specifically, the packs are defined by a respective wrapper 15', 17', made of suitable film, preferably of suitable plastic film.

More specifically, with reference to FIG. 3, which shows a first preferred embodiment of the plant 10, it can be seen that the plant comprises an apparatus 12 for making and packing articles, in particular in the form of rolls of absorbent paper, which is located downstream according to the direction of feed of the material along the plant and comprises respectively a first and a second line for making and packing, which are respectively labelled 12*a* and 12*b*.

However, it will be understood that the apparatus 12 for the making and the packing of articles could comprise one or more lines for making and packing the articles.

The respective line 12*a*, 12*b* for making and packing the articles has a respective operating speed.

The plant also comprises an apparatus, or section, in particular a rewinding machine 14 for making the semi-finished product, which is located upstream along the feed direction of the material being processed and which has a respective operating speed.

More specifically, the rewinding machine 14 for forming the rolls preferably comprises a series of operating sections which make the cartons or "logs", from which the rolls are cut, starting from a main reel for feeding the paper material or the like. The feeding reel is extremely large and is obtained directly from the factory for production of this material, in general from the paper mill. The rewinding machine comprises an initial section 2 of loading reels, which in general supports at least a first and a second of the feeding reels, to allow continuous feeding of the apparatus for making rolls, unwinding the web of paper from the feeding reel and transferring it to a subsequent section 4 wherein the paper is embossed to increase the volume of the web of paper. If necessary, different plies of paper are coupled to each other upstream of the embossing section.

There is then a rewinding section 3 which receives the core tubes from a special section for forming the tubes, on which a quantity of paper is glued and wrapped with a diameter corresponding to that of the rolls to be made, thus obtaining the elongate logs or reels to be cut into rolls. These elongate logs or reels are then sent to a subsequent section 16 for storing the elongate logs or reels and, from there, to the section 18, 18 for cutting rolls from the logs, as will become clearer as this description continues.

The plant therefore comprises means, or section, 16 for accumulating or storing the semi-finished products, from which the making and packing apparatus 12, that is, the respective making and packing line 12*a*, 12*b*, receives the semi-finished product, in particular in the form of respective logs or reels made of paper-based material, and which in turn receives the semi-finished product from the apparatus 14 which makes the semi-finished product.

More specifically, in this first preferred embodiment, the making and packing apparatus 12 downstream, in particular the respective working line 12*a*, 12*b*, comprises a respective cutting section or cutting machine 18, 18.

Each cutting machine 18, 18 is fed with the semi-finished product, in particular the logs made of paper-based material, from shared storage means, or storage system, 16.

Alternatively, according to a second preferred embodiment 100 illustrated in FIG. 4, a single and shared cutting machine 118 is used for both the lines 12*a*, 12*b* and there is an apparatus 119 downstream for diverting the articles towards the respective line 12*a*, 12*b*.

The cutting machine 118 receives the logs from the storage means, or storage system, 16.

Each cutting section or cutting machine 18, 18, 118 has a respective operating speed, in particular, having a maximum operating speed and a minimum operating speed for each respective size of article or roll being processed.

In these preferred embodiments, the making and packing apparatus 12 downstream, in particular the respective working line 12*a*, 12*b*, comprises one or more sequential packing stages.

More specifically, the making and packing apparatus 12 downstream, in particular the respective working line 12*a*, 12*b*, comprises a respective section, or machine, for packing articles, or rolls, in respective packs.

More specifically, the respective section, or packing machine, is labelled 20, in the respective drawings, and has a respective operating speed, in particular a maximum operating speed and a minimum operating speed, for the respective size of the pack to be made.

The making and packing apparatus 12 downstream, in particular the respective working line 12*a*, 12*b*, comprises, between the respective cutting section, or cutting machine 18, 18 and the respective section, or machine, 20, 20 for packing the articles, or rolls, in respective packs, respective conveying means, or section 21, 21.

More specifically, the conveyor means comprise respective conveyor belts 21, 21 which connect the outlet of the respective cutting machine 18, 18 to the inlet of the respective packing machine 20, 20.

More specifically, the conveyor belts 21, 21 have a plurality of conveying belts parallel to each other.

In accordance with a second preferred embodiment illustrated in FIG. 4, the conveying means or belts 21, 21 receive the articles or rolls from the diverting apparatus 119, which has a respective mobile, or pivoting, belt, preferably also comprising a plurality of parallel belts, which move alternatingly between the infeed of the conveying means 21, which lead to a first packing machine 20, and the infeed of the conveying means 21, which lead to a second packing machine 20, for transferring the articles alternatingly towards the one or the other packing machine.

The conveyor means 21, 21 also have a respective operating or conveying speed of the articles or rolls.

More specifically, the plant of the first and/or second preferred embodiment comprise a first and a second wrapping or packing machine 20, 20 and, respectively, first and second conveyor belts 21, 21.

In practice, the first preferred embodiment of the plant comprises a first and a second line for making and packing the articles which have a respective and dedicated cutting machine 18, 18, whilst the second preferred embodiment of the plant comprises a first and a second line for making and packing the articles which have a shared cutting machine 118. Moreover, the apparatus upstream of the first and/or second preferred embodiment of the plant comprises a single rewinding machine 14 and a single storage system 16, interposed between the rewinding machine and the respective cutting machines 18, 18 or 118.

The plant, in particular the first and/or second preferred embodiment of the plant, also comprises a respective section, or machine, 22, 22 for packing respective packs in corresponding containers, or bags made of respective film, in particular respective plastic film.

Between the respective section, or bagging machine, 22, 22 and the respective machine 20, 20 for packing in packs there are corresponding conveying means in the form of a respective short conveyor belt 23, 23.

The relative bagging section, or machine, 22, 22 has a respective operating speed, in particular a maximum operating speed and a minimum operating speed, for the particular pack or bag to be made.

More specifically, the first and/or second preferred embodiment of the plant comprise a first and a second bagging section, or machine, 22, 22.

As illustrated, the making and packing apparatus 12 downstream, in particular the respective working line 12*a*, 12*b*, comprises a respective palletizing section, or machine, 24, 24, in particular for palletizing the bags containing the packs.

As illustrated, the respective section, or machine, 24, 24 receives the bags directly from the corresponding bagging machine 22, 22.

However, it will be understood that, according to a further preferred embodiment (not illustrated in the accompanying drawings), the packs might also be palletized directly; in this case, the respective palletizing section, or machine, 24, 24 would receive the packs directly from the packing machine 20, 20.

The relative palletizing section 24, 24 also has a respective operating speed, in particular a maximum operating speed and a minimum operating speed.

As illustrated, the first and/or second preferred embodiment comprises a first and a second palletizing section or machine 24, 24.

The plant comprises respective control means including respective electronic processing means controlled by corresponding program means. More specifically, the respective packing section, or machine, 20, 20 has a respective control unit, in particular a PLC or an industrial PC, that controls autonomously, through a special software program, the extremely complex and elaborate operation of this type of machine. More specifically, this control unit of the packing section allows setting the operating speed of the packing machine, that is to say, the number of rolls processed per unit time, depending on the type of packs to be formed.

In turn, the conveying section or conveyor belts 21, 21 have a respective control unit, in particular a PLC or an industrial PC, that controls autonomously, through a special software program, the extremely complex and elaborate operation of this type of machine. More specifically, this control unit of the conveying section allows the operating speed of this conveying section to be set.

In turn, the section for making the articles 18, 18, 118 or the cutting machine has a respective control unit, in particular a PLC or an industrial PC, that controls autonomously, through a special software program, the extremely complex and elaborate operation of this type of machine. More specifically, this control unit of the making or cutting section allows setting the operating speed of the cutting machine, that is to say, the number of rolls processed per unit time.

The respective rewinding section or machine positioned upstream has a respective control unit, in particular a PLC or an industrial PC, that controls autonomously, through a special software program, the extremely complex and elaborate operation of this type of machine. More specifically, this control unit of the rewinding machine allows the operating speed of the machine to be set, which is preferably set equal to the maximum operating speed, which can be attained by the machines, with the aim of exploiting the potential to the maximum extent.

The respective bagging section, or machine, has a respective control unit, in particular a PLC or an industrial PC, that controls autonomously, through a special software program, the extremely complex and elaborate operation of this type of machine. More specifically, this control unit of the packing section allows the operating speed of the bagging machine to be set. The operating speeds may be defined in terms of number of rolls processed per unit time, depending on the type of bag to be formed.

In turn, the respective palletizing section, or machine, has a respective control unit, in particular a PLC or an industrial PC, that controls autonomously, through a special software program, the extremely complex and elaborate operation of this type of machine. More specifically, this control unit of the packing section allows the operating speed of the palletizing machine to be set. The operating speeds may be defined in terms of number of rolls processed per unit time, depending on the type of pallet to be formed.

This process is implemented, automatically, by corresponding electronic processing means, in particular by the electronic processing means of the conveying means 21, 21, under the control of a corresponding program. The process, implemented by the program, firstly comprises initially setting the operation of the plant, that is to say, the various units of the plant. For that purpose, according to the process, and relative implementation program, data is defined, more specifically data is obtained from the respective electronic processing units of the single sections or machines of the plant, relating to the maximum and minimum operating speeds, for the particular size of product being processed, that is to say, in particular, respectively, the size of the roll, the size of the pack, the size of the bag and the size of the pallet to be formed.

In practice, each section of the plant for the respective size of product being processed has a respective maximum operating speed and a respective minimum operating speed.

In practice, the electronic processing means which implement the respective programme for controlling the flow of products along the plant receive, preferably from the electronic processing means or control unit of the respective sections of the plant, the data relating to the maximum and minimum operating speeds for the particular size of product being processed.

At this point, the process, and the related program, determines the operating speed of the sections of the plant in such a way that the flow of material along the line is in the form of a constant flow, and does not generate interruptions to the operation of the plant, that is to say, of the various sections of the plant, unlike what is the case according to the prior art, due to the effect of insufficient or excessive loading conditions, at the respective section or machine.

After determining or defining the operating speed which the respective sections of the plant must have, the electronic processing means housing the respective program for controlling product flow along the plant provides to the electronic processing means or control unit of the respective plant sections the operating speed value for the corresponding plant section. Advantageously, according to the process, the operating speed of the plant is set in such a way as to be between the minimum of the maximum speeds of the sections of the plant and the maximum of the minimum speeds of the sections of the plant.

Preferably, however, so as not to condition the operation of the apparatus for making the semi-finished products or logs, which is quite a complex apparatus and which it would be worthwhile not subjecting to conditioning under its normal work cycle, advantageously, according to the process, the operating speed of the apparatus for making and packing downstream, that is to say, of the respective lines, is set in such a way as to be between the minimum of the maximum speeds of the respective sections and the maximum of the minimum speeds of the same sections.

In practice, an interval of admissibility is determined for the operating speed of the plant, and in particular of the making and packing apparatus downstream, that is, of the respective line.

Moreover, the process determines the operating speed of the plant, or of the apparatus for making and packing the articles, that is to say, of the respective line, so that it falls within the interval of admissibility.

In this way, it is possible to avoid errors in setting the operating speeds of the respective sections, thereby obtaining a uniform flow of products advancing and processed along the plant.

For example, for a particular type of roll and type of pack, containing 12 rolls, the respective maximum operating speed of the machine or packing section or packing machine could be equal to 40 packs per minute (corresponding to 480 rolls per minute), whilst the corresponding minimum operating speeds could be equal to 20 packs per minute (corresponding to 240 rolls per minute).

In turn, for a particular type of roll, the maximum operating speed of the machine or cutting section could be equal to 240 cycles per minute (corresponding to 861 rolls per minute) and the minimum operating speed could be equal to 50 cycles per minute (corresponding to 179 rolls per minute). In this case, the maximum operating speed for the plant is set to 480 rolls per minute, whilst the minimum operating speed is set to 240 rolls per minute. This all assumes that the other units of the plant have maximum operating speeds which are much higher than those of the above-mentioned working sections and minimum operating speeds which are not particularly significant for the operation of the plant.

It will be understood that once this program has determined the operating speeds which the various sections, or machines, of the plant must have, the operating speeds of these are set accordingly, in particular sending corresponding instructions and/or data to the respective electronic processing unit of the single sections or machines.

Advantageously, according to the process, the operating speed of the sections of the plant, or of the apparatus for making and packing the articles, is adjusted continuously as a function of an operating condition of one or more of the sections of the plant, in particular of one or more of other sections of the plant, preferably not subjected to adjustment.

More specifically, for continuously adjusting the speed of the sections of the plant, or in particular only of the apparatus for making and packing the articles, a respective reference operating condition of one or more of the sections of the plant is kept monitored or controlled, and, when this operating condition changes, in particular in a predetermined manner, from the reference operating condition, the operating speed of the sections of the plant is modified in such a way as to restore the reference operating condition in the respective operating section.

Preferably, advantageously, the operating speed of the sections of the plant, or the apparatus for making and packing the articles, is adjusted continuously as a function of the speed of the apparatus, or rewinding machine, for making the semi-finished product upstream.

Preferably, advantageously, the operating speed of the sections of the plant, or the apparatus for making and packing the articles, is adjusted continuously as a function of the filling level of the semi-finished product in the accumulation means, or section, 16.

According to a preferred regulating method, the operating speed of the respective packing section, or machine, 20, 20 of the making and packing apparatus is a function of the operating speed of the apparatus, or section, 14 positioned upstream for making the semi-finished product.

Preferably, advantageously, the operating speed of the plant sections, or of the apparatus for making and packing the articles, is adjusted continuously as a function of the filling level of the product conveying means, or section, in particular of the means, or section, for conveying the product between the respective section for making the article and the packing section.

Preferably, according to the process, the operating speed of the making and packing apparatus 12 downstream, that is, of the respective making and packing line 12*a*, 12*b*, is adjusted in such a way that the semi-finished product in the accumulation means or section 16 is kept around a predetermined filling level.

In this way, in the case of temporary interruptions or slow-downs in the receiving of products by the apparatus downstream, the possibility of storing the semi-finished product for a predetermined time is ensured, thus avoiding the need to stop the apparatus upstream.

In practice, the apparatus for making the semi-finished product 14 does not vary its operating speed when the operating speed of the respective line 12*a*, 12*b* of the making and packing apparatus downstream is modified, in particular, when operations are performed for adjusting the operation of the apparatus downstream to keep the product in the accumulation means 16 at a predetermined filling level.

It must, however, be understood that the operating speed of the apparatus upstream 14, or rewinding machine, which makes the semi-finished product, that is to say, the logs of absorbent paper, the logs having the same diameter as the corresponding rolls, which are made from this, has a respective operating speed, normally expressed in this type of machine in logs per minute, may vary as a function of particular operating requirements of the rewinding machine. More specifically, the operating speed of the rewinding machine may be lower than the steady-state speed during the initial steps of processing a respective large reel of paper-based material, that is, during the last step of processing the same large reel.

However, it will be understood that, in the case of a total block of the apparatus for making and packing the articles or rolls for a prolonged period of time it might prove necessary to also stop the rewinding machine 14 upstream.

In practice, the respective operating speed of the respective line 12*a*, 12*b* of the making and packing apparatus 12 downstream is set and adjusted in such a way that the means 16 for accumulating the semi-finished product is kept at a predetermined filling level.

More specifically, the predetermined filling level of the accumulation means 16 is such as to allow an accumulation of semi-finished product in the accumulation means 16, to such an extent that in the case of variation of an operating condition of the making and packing apparatus 12 downstream, in particular of a respective working line 12*a*, 12*b*, which results in a reduced capacity of absorption of semi-finished products by the apparatus downstream, it is not necessary, for a predetermined time, to slow down the operating speed or stop the apparatus upstream which feeds the accumulation means 16.

More specifically, the predetermined filling level of the accumulation means 16 is less than half the completely full level of the accumulation means 16, in particular less than 10% of the completely full level of the accumulation means 16, and preferably substantially equal to 5% of the completely full level of the accumulation means 16.

More specifically, the predetermined filling level of the accumulation means 16 corresponds to the height reached by the semi-finished product in the accumulation means, or storage system, 16.

In practice, the operating speed of the respective packing section, or machine 20, 20 of the making and packing apparatus is a function of, or proportional to, the deviation of the filling level of the means 16 for accumulating the semi-finished product relative to the predetermined filling or safety level.

In this way, it is possible to vary the speed of the respective packing section, or machine, 20, 20 as a function of the actual filling of the accumulation means 16, so as to maintain, or reach, the predetermined filling or safety level.

According to a further advantageous aspect, when the plant, in particular the apparatus for making and packing the articles, has a plurality of working lines, in particular as illustrated, a first and a second working line 12*a*, 12*b*, the articles are divided, or fed, in a manner proportional to the working capacity of the respective line, in particular for the size of the product being processed.

More specifically, preferably, the operating speed of the respective line 12*a* or 12*b* is set in proportion to the maximum operating speed which the same line has for that particular size of the product being processed.

In practice, the production of the apparatus 14 upstream is divided between the lines downstream in proportion to the respective maximum operating speed of the same line for that particular size.

In practice, the operating speed of the respective line 12*a*, 12*b* downstream, that is, preferably of the packing section 20, 20, which is preferably served by the other sections of the respective line, is a function of the speed of the rewinding machine 14 upstream, which is divided in proportion to the respective maximum speed, for the particular size, of the line, or packing section, in relation to the sum of the maximum operating speeds (for the respective size) of all the lines (in particular of both the lines of the present preferred embodiments) or of the packing sections. More specifically, the production of the rewinding machine 14 upstream is divided equally between the lines downstream 12*a*, 12*b*, when the same lines 12*a*, 12*b*, or packing sections, have the same maximum operating speed, for the respective size.

According to a preferred process, for the first preferred embodiment of the plant, once an operating speed of the respective packing section, or machine 20, 20 has been determined of a respective line 12*a*, 12*b* of the apparatus downstream for making and packing the articles, the operating speed of the corresponding section for making the articles, or cutting machine, 18, 18, of the respective line 12*a*, 12*b* of the apparatus downstream for making and packing the articles, is a function of the operating speed determined for the corresponding same section, or machine, 20, 20 for packing the articles.

In practice, the operating speed of the corresponding section for making the articles, or cutting machine, 18, 18, of the respective line 12*a*, 12*b* of the apparatus downstream for making and packing the articles, is controlled at the operating speed of the corresponding same section, or machine, 20, 20 for packing the articles.

Preferably, the operating speed of the corresponding section for making the articles, or cutting machine, 18, 18, of the respective line 12*a*, 12*b* of the apparatus downstream for making and packing the articles, is as a function of, or proportional to, the change in the real, or actual, operating speed of the corresponding section, or machine, 20, 20 for making the articles relative to the predetermined or predefined operating speed, in particular during the initial setting of the operation of the plant of the same section, or machine, 20, 20 for packing the articles.

In this way, for example, if the actual operating speed of the packing machine 20 of the respective line 12*a* or 12*b* is less than the operating speed initially predetermined for this, the operating speed of the section for making the articles, or cutting machine, 18, 18 is reduced correspondingly.

Moreover, the operating speed of the section, or cutting machine, 18, 18, for making the articles of the respective line 12*a*, 12*b* of the apparatus for making and packing the articles is a function of the reaching of a minimum filling level or of a maximum filling level of the corresponding section 21, 21 for conveying the articles to the corresponding packing section 20, 20.

In practice, this takes into account any errors accumulated in the production, in particular of slowed-down or speeded-up operation, which are not otherwise detected by the control system and which lead to an excessive, or insufficient, loading of articles on the conveyor means.

In practice, the conveying means, or the respective section, 21, 21 comprises sensors for detecting an excessive loading, or too full, condition, or an insufficient loading, or too empty, condition of the articles being fed to the respective packing section, or machine, 20, 20. For this reason, when the respective conveying section 21, 21 is in the too empty condition, the operating speed of the section, or cutting machine, 18, 18 upstream is increased, in particular proportionally. When the respective conveying section 21, 21 is in the too full condition, on the other hand, the operating speed of the section, or cutting machine, 18, 18 upstream is decreased, in particular proportionally.

According to a further advantageous aspect, starting from a predetermined operating condition, more product may be fed on a respective line, in particular in such a way as to saturate or fill the line. In this case, it is preferable not to interrupt the feeding of product towards the other line to which product is fed in such a way that the operating speed of this line is greater than the operating speed of the same line.

The invention described above is susceptible of industrial application. It would be obvious to one skilled in the art that several changes and modifications can be made to the invention without departing from the spirit and scope of the invention, described in depth above. It is also easy to imagine further embodiments of the invention comprising one or more of the features described herein. It will also be understood that all the details of the invention may be substituted for technically equivalent elements.

The invention claimed is:

1. A process for managing a flow of material along a direction of feed of a plant for making and packing articles obtained from semi-finished products in the form of elongate pieces or elements made of paper-based material, comprising:

packing the articles to form respective packs containing one or more of the articles housed in a respective container or wrapper, the plant used by the process including a plurality of plant sections including at least each of a rewinding machine that supplies the semi-finished products, an apparatus for making and packing the articles from the semi-finished products, an accumulation section, and a control unit, the apparatus for making and packing the articles located downstream from the rewinding machine along the direction of feed and having working sections along one or more working lines for making and for packing the articles, respectively, the accumulation section configured for accumulating or storing the semi-finished products, from which the apparatus for making and packing the articles receives the semi-finished products and which in turn receives the semi-finished products from the rewinding machine that supplies the semi-finished products, and the control unit, which includes an electronic processing system controlled through corresponding program instructions, being configured to detect filling values representative of a filling level of the semi-finished products in the accumulation section, provide a continuous comparing of the filling values with a predetermined filling level, and generate operating instructions for varying a speed of the apparatus for making and packing the articles, which is located upstream of the accumulation section, in such a way as to vary continuously a number of articles processed per unit of time by the apparatus for making and packing the articles, so that the semi-finished products in the accumulation section are kept at the predetermined filling level.

2. The process according to claim 1, wherein the operating speed of the apparatus for making and packing the articles is adjusted in such a way that the level of the semi-finished products in the accumulation section is kept at the predetermined filling level.

3. The process according to claim 2, wherein the predetermined filling level is less than half a completely full level of the accumulation section.

4. The process according to claim 1, wherein an operating speed of a respective packing machine or section of the making and packing apparatus is a function of an operating speed of the upstream apparatus or section for making the semi-finished product.

5. The process according to claim 1, wherein an operating speed of a working section for making the articles of the apparatus for making and packing the articles is controlled as a function of a predetermined operating speed for a corresponding working section for packing the articles of the apparatus for making and packing the articles.

6. The process according to claim 1, wherein an operating speed of a working section for making the articles of the apparatus for making and packing the articles is controlled as a function of a deviation of an actual operating speed of a corresponding working section for packing the articles of the apparatus for making and packing the articles from a predetermined operating speed of the corresponding working section for packing the articles of the apparatus for making and packing the articles.

7. The process according to claim 1, wherein a working section for making the articles of the apparatus for making and packing the articles is connected to a corresponding working section for packing the articles of the apparatus for making and packing the articles by a conveying section, and wherein an operating speed of the working section for making the articles of the apparatus for making and packing the articles is controlled as a function of a load of the articles upon the conveying section with respect to at least one of a minimum filling level of the conveying section and of a maximum filling level of the conveying section.

8. The process according to claim 1, wherein the apparatus for making and packing the articles further comprises respective working sections having, for each product size, respective maximum operating speeds and minimum operating speeds, and wherein the operating speed of the apparatus for making and packing the articles is determined and set in such a way as to be between the lowest of the maximum speeds of the sections of the apparatus for making and packing the articles and the highest of the minimum speeds of the sections of the apparatus for making and packing the articles.

9. The process according to claim 1, further comprising:

obtaining data relating to the maximum and minimum operating speeds for a product size of the articles.

10. The process according to claim 1, wherein when the plant, has a plurality of working lines, and the articles made upstream are divided in proportion to a working capacity of each of said respective lines based on a size of the articles.

11. The process according to claim 10, wherein an operating speed of each line of said respective lines is determined in proportion to a maximum operating speed of said line based on the size of the articles.

12. The process according to claim 10, wherein production carried out by the rewinding machine that supplies the semi-finished product is divided between the plurality of working lines in proportion to respective maximum operating speeds of the working lines based on a size of the articles processed each one of said working lines.

13. The process according to claim 1, wherein the apparatus for making and packing the articles includes a cutting section that forms the semi-finished products into logs or roll products of paper material.

14. The process according to claim 13, wherein the apparatus for making and packing the articles includes a conveying section located between the cutting section and the respective section for packing the articles in respective packs.

15. The process according to claim 1, wherein the apparatus for making and packing the articles includes a section for packing the articles in respective packs.

16. The process according to claim 15, wherein the apparatus for making and packing the articles includes a section for packing the respective packs in corresponding containers or bags of film.

17. The process according to claim 16, wherein the apparatus for making and packing comprises a respective downstream section for palletizing the containers or bags of film.

18. The process according to claim 1, wherein an operating speed of each of the plant sections is adjusted continuously as a function of a filling level of the accumulation section.

19. The process according to claim 1, wherein a working section for making the articles of the apparatus for making and packing the articles is connected to a corresponding working section for packing the articles of the apparatus for making and packing the articles by a conveying section, and wherein an operating speed of each of the plant sections is adjusted continuously as a function of a filling level of the conveying section.

20. The process according to claim 1, wherein an operating speed of the apparatus for making and packing the articles is adjusted continuously as a function of a speed of the rewinding machine.

21. The process according to claim 1, further comprising:

feeding more product on a respective line in such a way as to saturate or fill the line.

* * * * *